US012410004B2

(12) United States Patent
Hsieh et al.

(10) Patent No.: US 12,410,004 B2
(45) Date of Patent: Sep. 9, 2025

(54) SHIPPING CONTAINER CONNECTOR

(71) Applicant: Formosa Forges Corporation, Nantou (TW)

(72) Inventors: Jung-Kuang Hsieh, Taichung (TW); Pei-Yi Yang, Nantou (TW)

(73) Assignee: Formosa Forges Corporation, Nantou (TW)

( * ) Notice: Subject to any disclaimer, the term of this patent is extended or adjusted under 35 U.S.C. 154(b) by 30 days.

(21) Appl. No.: 18/444,937

(22) Filed: Feb. 19, 2024

(65) Prior Publication Data

US 2025/0115419 A1 Apr. 10, 2025

(30) Foreign Application Priority Data

Oct. 4, 2023 (TW) ..... 112138155

(51) Int. Cl.
*B65D 90/00* (2006.01)

(52) U.S. Cl.
CPC .. *B65D 90/0006* (2013.01); *B65D 2590/0008* (2013.01)

(58) Field of Classification Search
CPC ..... B65D 21/02; B65D 2519/00577; B65D 90/0026; B65D 90/0006; B65D 2590/0008; B65D 90/0013; B65D 2501/24605; B65D 21/0204
See application file for complete search history.

(56) References Cited

U.S. PATENT DOCUMENTS 4,695,184 A * 9/1987 Robishaw ..... B65D 90/0013 403/321
4,928,616 A * 5/1990 Robishaw ..... B65D 88/121 414/800
5,688,086 A * 11/1997 Menzemer ..... B65D 88/128 403/231
5,806,701 A * 9/1998 Bae ..... B65D 88/121 206/509
5,996,828 A * 12/1999 Cheyn ..... B65D 11/1873 220/4.31
6,363,586 B1 * 4/2002 Neufingerl ..... B65D 88/005 24/287
8,835,763 B1 * 9/2014 Hammond ..... H02G 3/12 174/67
2009/0047090 A1 2/2009 Brewster
2013/0313269 A1 * 11/2013 Peterson ..... B65D 90/0026 220/629
2015/0344223 A1 * 12/2015 Hwang ..... B65D 90/0013 220/1.5

* cited by examiner

*Primary Examiner* — Kareen K Thomas
(74) *Attorney, Agent, or Firm* — Michael Best & Friedrich LLP

(57) ABSTRACT

A shipping container connector includes a first latch unit, a second latch unit and a pulling rope unit. The first latch unit has a first body member, a first latch portion. The first body member has two side walls cooperatively defining a mounting space. One of the side walls has a threading hole. The second latch unit is disposed in the mounting space, and includes a second body member, and a spring member. The pulling rope unit extends through the threading hole, and has an end fixed to the second latch unit, and an opposite end disposed outside of the threading hole. When the pulling rope unit is pulled, the second latch unit is driven to move relative to the first latch unit from a locked position to a released position, where the spring member accumulates a biasing force for biasing the second latch unit towards the locked position.

10 Claims, 12 Drawing Sheets

SHIPPING CONTAINER CONNECTOR

CROSS-REFERENCE TO RELATED APPLICATION

This application claims priority to Taiwanese Invention Patent Application No. 112138155, filed on Oct. 4, 2023, the entire disclosure of which is incorporated by reference herein.

FIELD

The disclosure relates to a device for connecting shipping containers, and more particularly to a shipping container connector.

BACKGROUND

A shipping container includes four corner castings mounted on four top corners of the shipping container, and four corner castings mounted on four bottom corners of the shipping crate. To secure stacked shipping containers during ocean freight shipping, four conventional shipping container connectors are respectively mounted to the bottom corner castings of a top shipping container. When the top shipping container is transported to a cargo ship, lifted above, and lowered onto a bottom shipping container, the shape and structural design of the conventional shipping container connectors allow the conventional shipping container connectors that are mounted to the bottom corner castings of the top shipping container to smoothly and respectively engage with the top corner castings of the bottom shipping container, thereby securing the top shipping container to the bottom shipping container.

A conventional shipping container connector as disclosed in Chinese Patent Publication No. 101027233B is adapted for connecting two shipping containers that are vertically stacked, and includes a first latch unit, a second latch unit, and a fastening unit. The first latch unit is adapted for engaging with a corner casting of an upper shipping container, and the second latch unit is adapted for engaging with a corner casting of a lower shipping container. The fastening unit includes a block member that is movably disposed in the first latch unit, and a compression spring that supports and abuts against the block member. The fastening unit prevents the conventional shipping container connector from erroneously disengaging from a corner casting of an upper shipping crate of the two shipping containers during transportation.

Referring to FIGS. 1 to 3, a commercially available shipping container connector 100 is similar to the above-mentioned conventional shipping container connector illustrated in Chinese Patent Publication No. 101027233B. The commercially available shipping container connector 100 includes a first latch unit 11 adapted for engaging with a bottom of a shipping container 101, a second latch unit 12 opposite to the first latch unit 11, and a fastening unit 13. The fastening unit 13 includes a block member 131 and a compression spring 132. To disengage the commercially available shipping container connector 100 from the shipping container 101, a user must reach one hand to the commercially available shipping container connector 100 and downwardly pull the block member 131 from a locked position (see FIG. 2) to a released position (see FIG. 3), while the other hand of the user grips and rotates the commercially available shipping container connector 100. Therefore, the user is required to stand proximate to the shipping container 101 in order to reach the commercially available shipping container connector 100, which reduces safety and convenience during operation.

SUMMARY

Therefore, an object of the disclosure is to provide a shipping container connector that can alleviate at least one of the drawbacks of the prior art.

According to the disclosure, the shipping container connector is adapted to be engaged with a first corner casting and a second corner casting. The shipping container connector includes a first latch unit, a second latch unit, and a pulling rope unit. The first latch unit has a first body member, a first latch portion, and a protruding portion. The first body member and the first latch portion are arranged in a vertical direction. The protruding portion is disposed on a bottom end of the first body member, and is adapted to be inserted into the second corner casting. The first latch portion is connected to a top end of the first body member, and is adapted to be engaged with the first corner casting. The first body member has two side walls. The side walls are spaced apart in a horizontal direction perpendicular to the vertical direction, and each of the side walls has a top end that is connected to the first latch portion. The two side walls cooperatively define a mounting space therebetween. One of the side walls has a threading hole that is adapted to interconnect the mounting space and the external environment. The second latch unit is disposed in the mounting space, is vertically movable, and includes a second body member and a spring member. The second body member is disposed between the side walls, and has a second latch portion. The spring member is disposed between the second body member and the first latch unit. The pulling rope unit extends through the threading hole, and has an end that is fixed to the second latch unit, and an opposite end that is disposed outside of the threading hole. When the opposite end of the pulling rope unit is pulled, a force that is transverse to the vertical direction is generated to drive the second latch unit to move relative to the first latch unit from a locked position to a released position. When the second latch unit is in the locked position, the second latch portion is adjacent to the first latch portion, so that the second latch portion and the first latch portion are adapted for cooperatively engaging with the first corner casting. When the second latch unit is in the released position, the second latch portion is away from the first latch portion, so that the second latch portion and the first latch portion are adapted to be disengaged from the first corner casting, and the spring member accumulates a biasing force for biasing the second latch unit towards the locked position.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
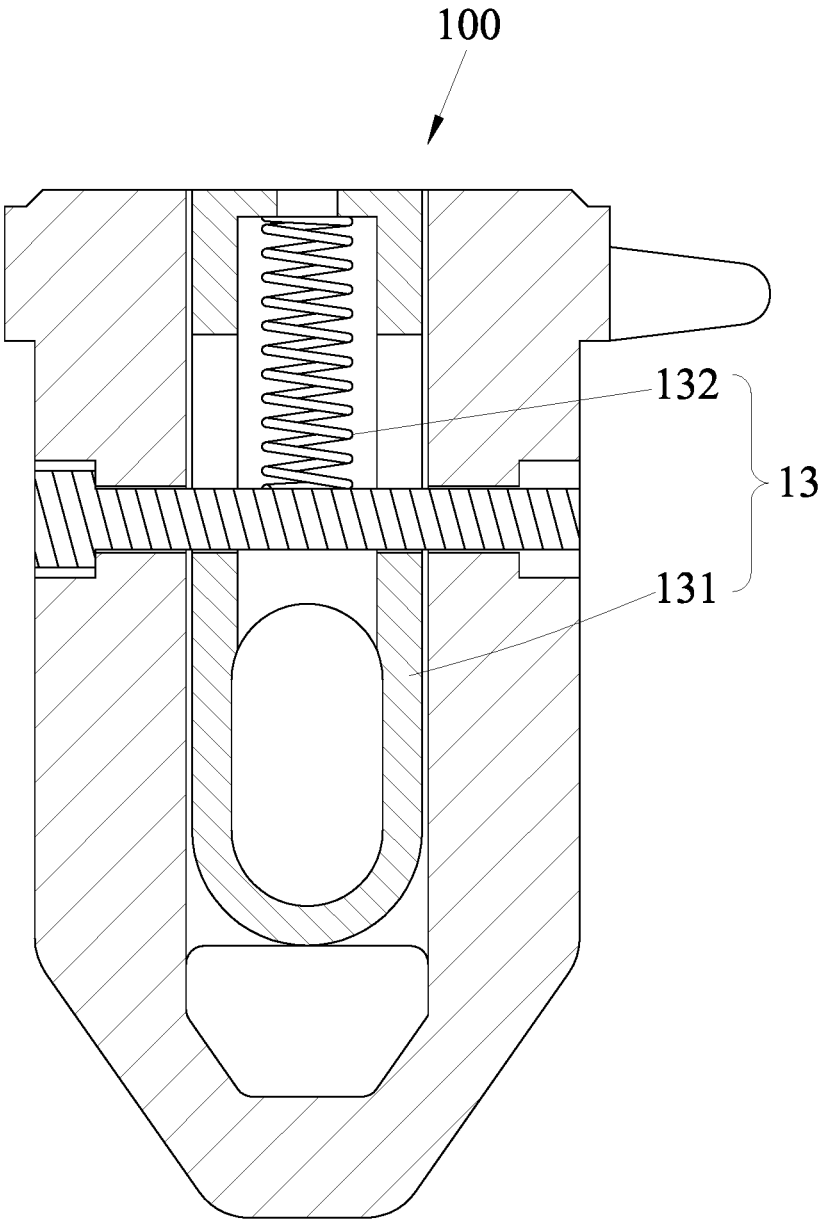
FIG. 1 PRIOR ART
FIG. 1 is a sectional view of a commercially available shipping container connector.
Figure 3:
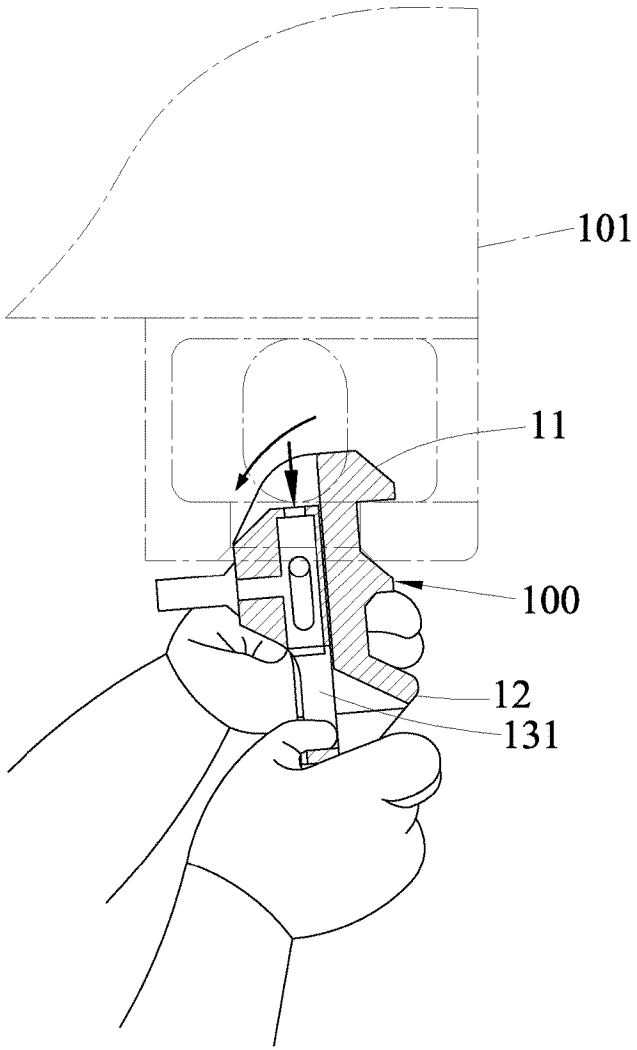
FIG. 3 PRIOR ART
FIG. 3 is a schematic sectional view illustrating the commercially available shipping container connector when the block member being moved to a released position.
Figure 2:
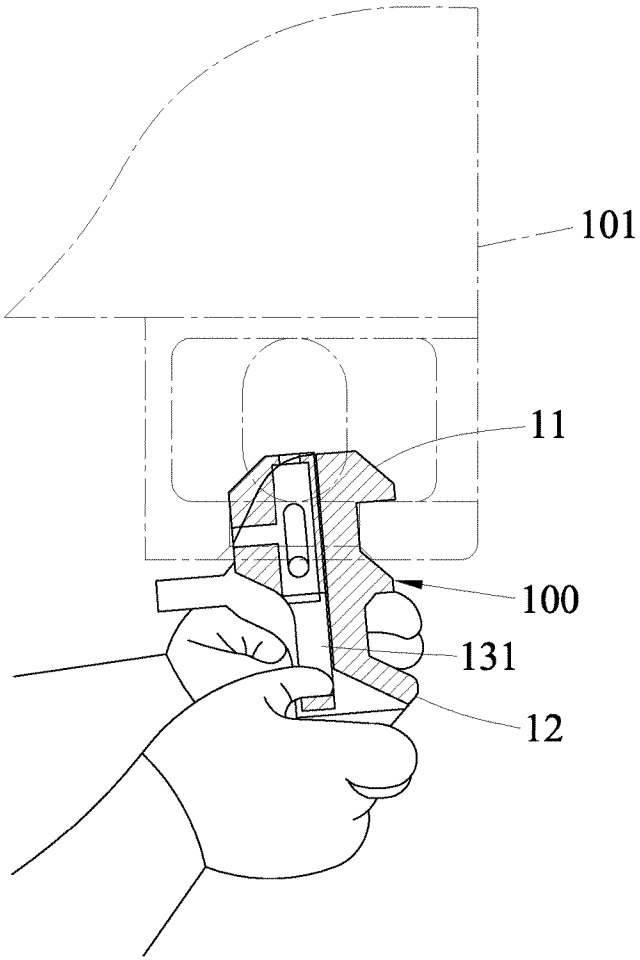
FIG. 2 PRIOR ART
FIG. 2 is a schematic sectional view illustrating a user operating the commercially available shipping container connector when a block member being in a locked position.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 4:
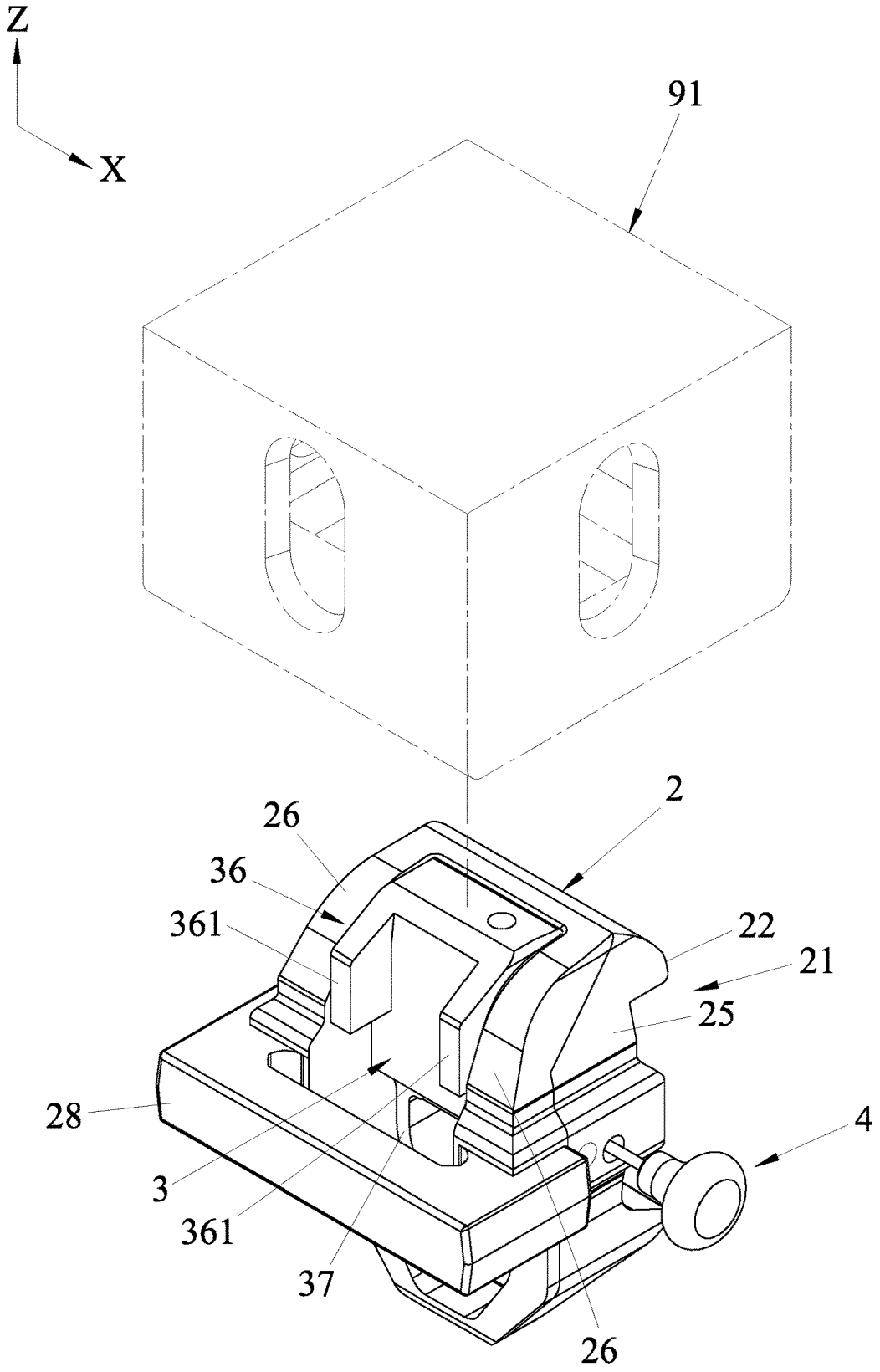
FIG. 4 is a schematic perspective view of an embodiment of a shipping container connector according to the disclosure and a first corner casting.
Figure 5:
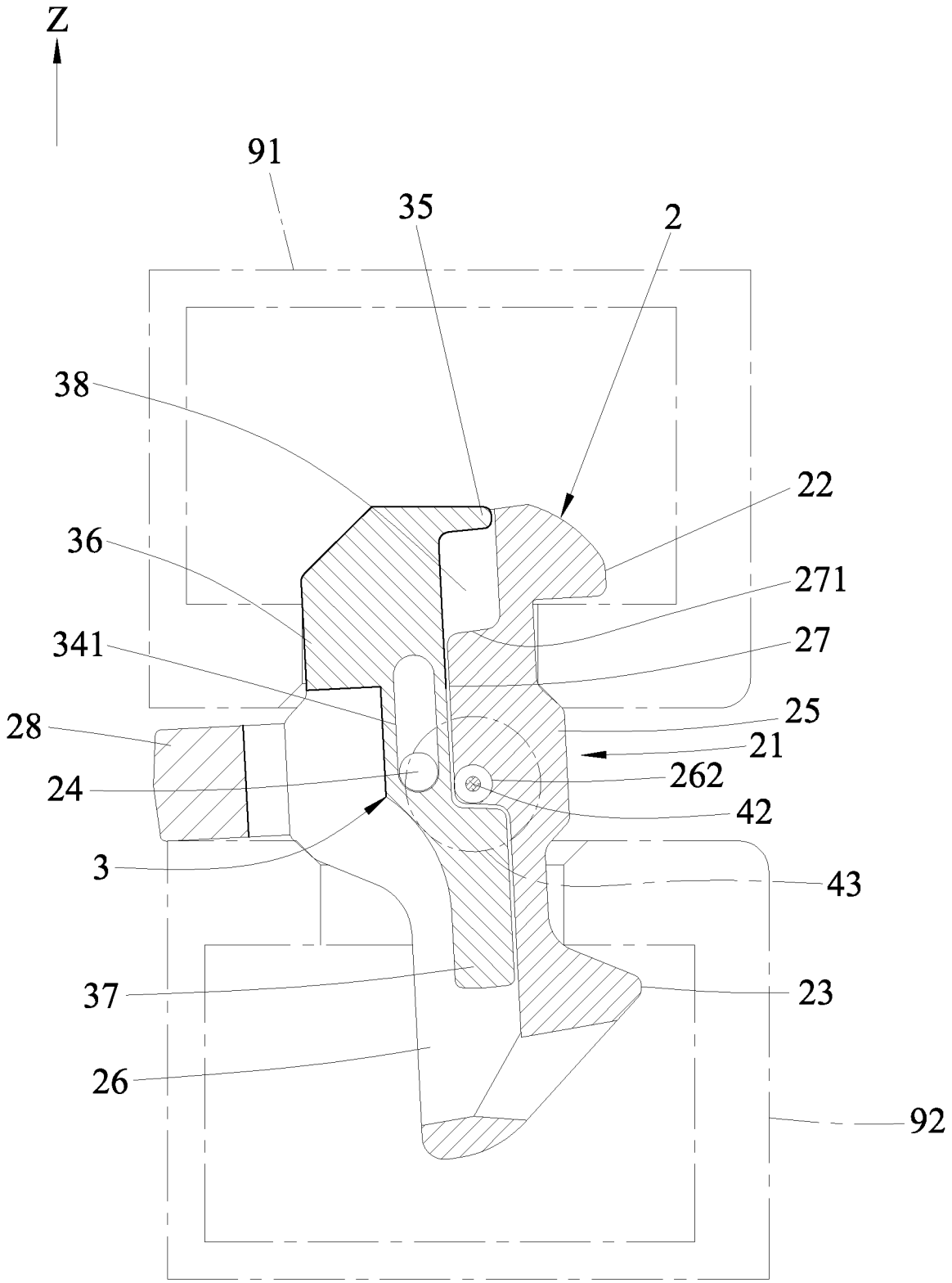
FIG. 5 is a schematic sectional view of the embodiment engaged with the first corner casting and a second corner casting.
Figure 6:
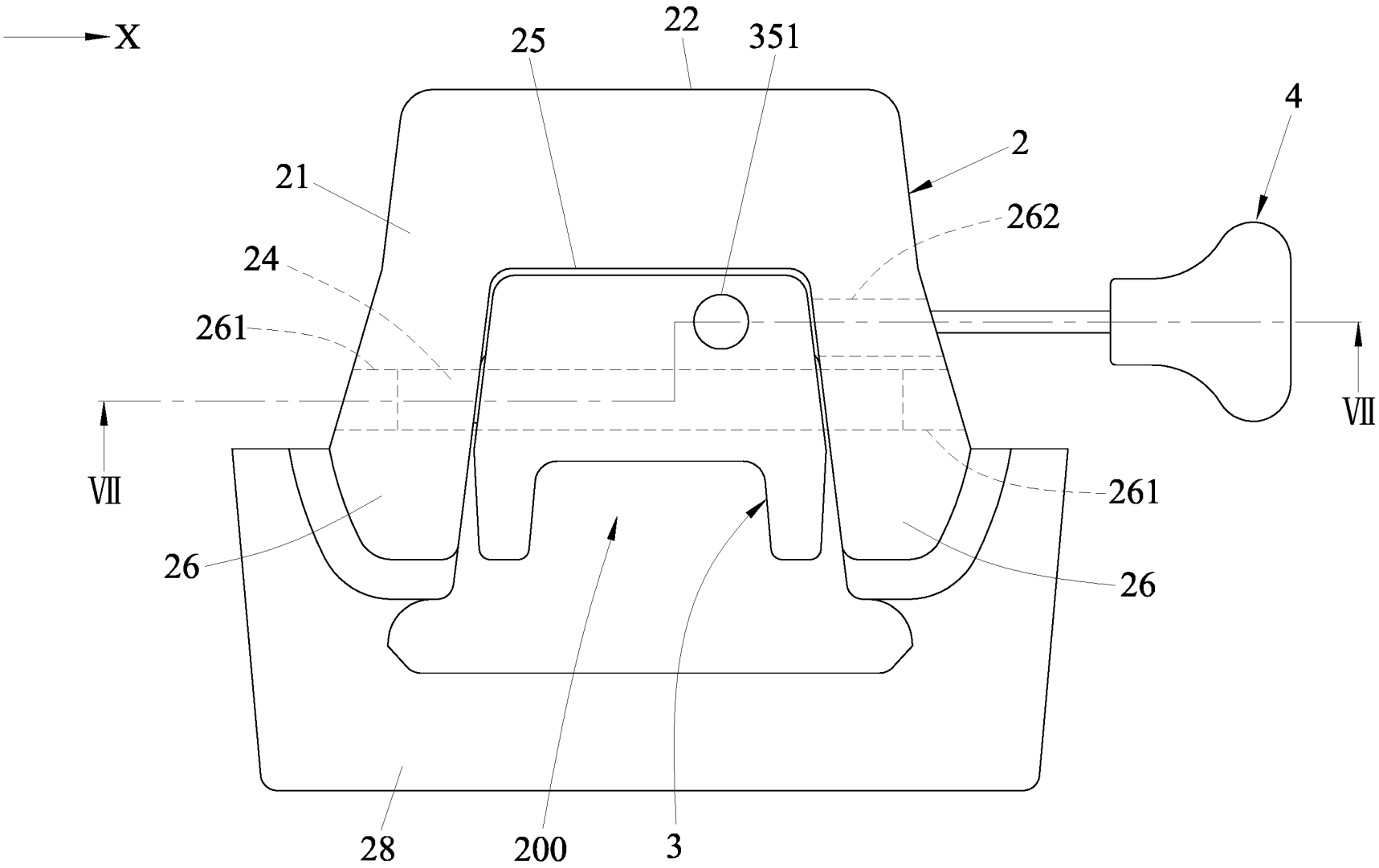
FIG. 6 is a fragmentary top view of the embodiment.

Referring to FIGS. 4 to 6, an embodiment of a shipping container connector according to the disclosure is adapted to be engaged with a first corner casting 91 and a second corner casting 92. The first corner casting 91 is fixed to a bottom surface of an upper shipping container (not shown), and the second corner casting 92 is fixed to a top surface of a bottom shipping container (not shown). The first corner casting 91 and the second corner casting 92 are known in the prior art and are not distinctive features of the disclosure; hence, they will not be discussed in further detail. The shipping container connector includes a first latch unit 2, a second latch unit 3, and a pulling rope unit 4.

The first latch unit 2 has a first body member 21 and a first latch portion 22 arranged in a vertical direction (Z), a protruding portion 23 disposed on a bottom end of the first body member 21, and a mounting rod 24 disposed in the first body member 21. The first latch portion 22 is connected to a top end of the first body member 21.

The first body member 21 has a base wall 25 extending in the vertical direction (Z), two side walls 26 disposed on the base wall 25 and spaced apart from each other in a horizontal direction (X) that is perpendicular to the vertical direction (Z), a platform 27 formed on the base wall 25, and a connecting wall 28 extending in the horizontal direction (X) and interconnecting the side walls 26. The two side walls 26 cooperatively define a mounting space 200 therebetween, and each of the side walls 26 has an installation hole 261. One of the side walls 26 further has a threading hole 262 extending in the horizontal direction (X), and adapted to interconnect the mounting space 200 and the external environment. In other embodiments, the threading hole 262 may be inclined relative to the horizontal direction (X) and the vertical direction (Z).

Figure 7:
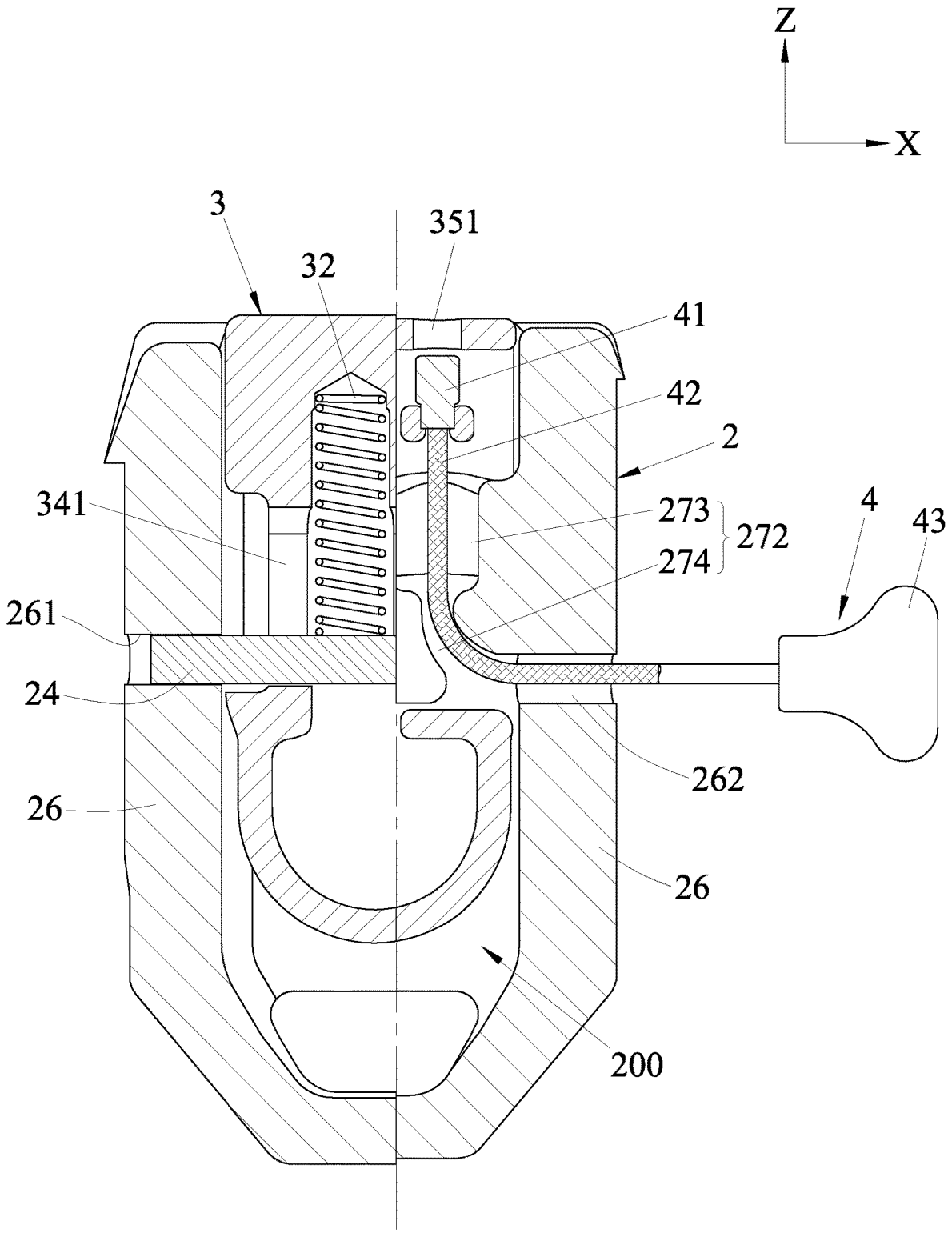
FIG. 7 is an offset sectional view of the embodiment taken along line VII-VII in FIG. 6, illustrating a second latch unit in a locked position.

Referring to FIGS. 5 and 7, the platform 27 is disposed in the mounting space 200, and has a top surface 271 formed on a top portion of the platform 27, and a rope groove 272 formed in the platform 27, being proximal to the second latch unit 3, and disposed between the side walls 26. The rope groove 272 has a straight groove portion 273 that is elongated in the vertical direction (Z), and a curved groove portion 274 that is curved and extends from the straight groove portion 273 to the threading hole 262.

Referring back to FIGS. 4 to 6, the connecting wall 28 is U-shaped, and has a top surface and a bottom surface, and two ends that are opposite to each other in the horizontal direction (X), and that respectively extend beyond the side walls 26. The connecting wall 28 is horizontally aligned with the threading hole 262. When the embodiment is engaged with the first corner casting 91 and the second corner casting 92, the first corner casting 91 and the second corner casting 92 are separated by the connecting wall 28.

Each of the side walls 26 has a top end, and the first latch portion 22 is connected to the top ends of the side walls 26, and is adapted to be engaged with the first corner casting 91. The protruding portion 23 is disposed opposite to the side walls 26, and is adapted to be inserted into the second corner casting 92. The mounting rod 24 has opposite ends respectively disposed in the installation holes 261 of the side walls 26.

Figure 8:
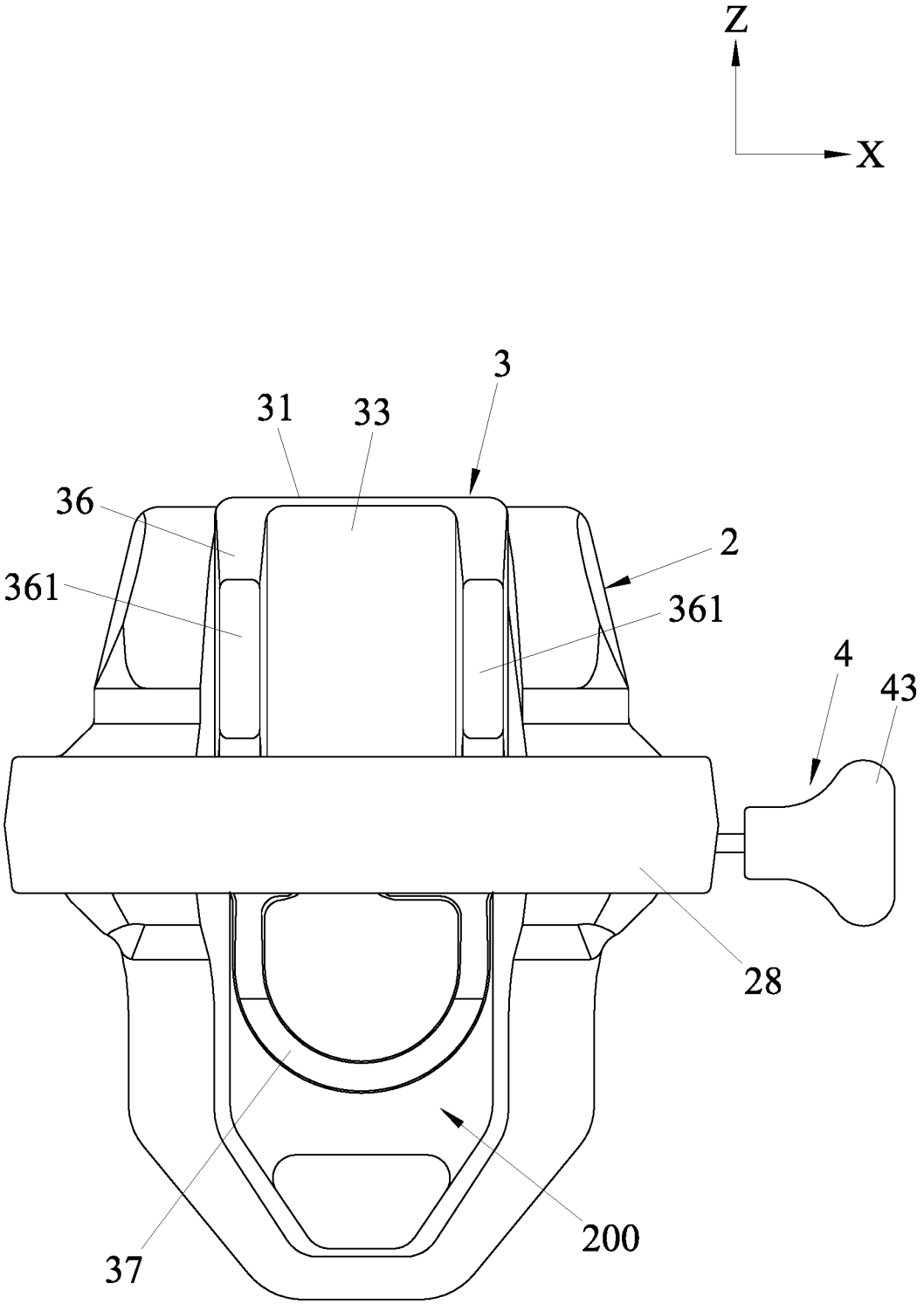
FIG. 8 is a front view of the embodiment illustrating the second latch unit in the locked position.
Figure 9:
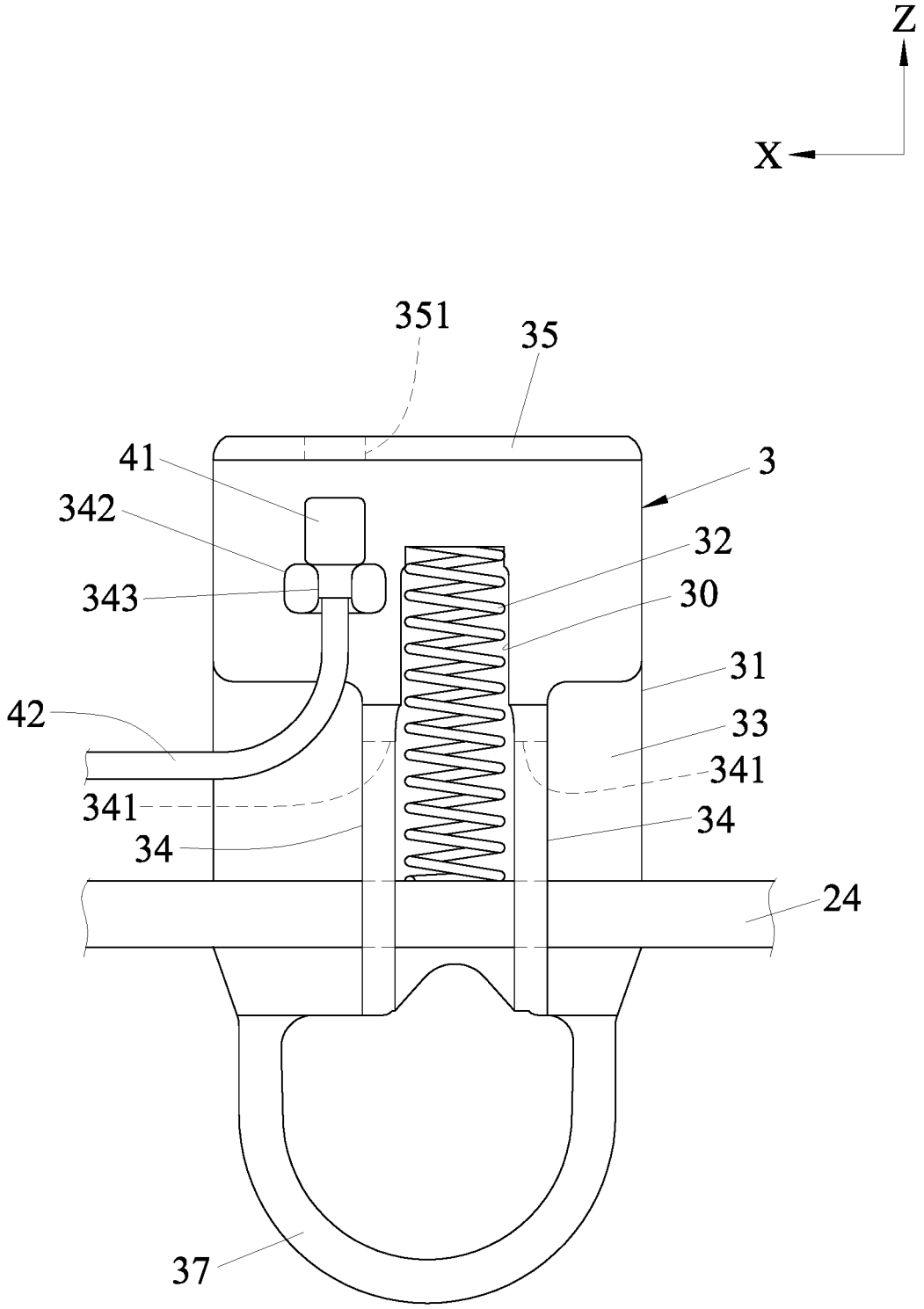
FIG. 9 is a fragmentary rear view of the second latch unit and a mounting rod.

Referring to FIGS. 5, 8 and 9, the second latch unit 3 is vertically movable, is disposed in the mounting space 200, and includes a second body member 31 disposed between the side walls 26, and a spring member 32 disposed between the second body member 31 and the mounting rod 24 of the first latch unit 2.

The second body member 31 has a main wall 33, two end walls 34 that are connected to a surface of the main wall 33 facing the base wall 25, and that are spaced apart from each other, a hook wall 35 that is disposed on a top portion of the main wall 33, a second latch portion 36 that is formed on the main wall 33 and that is opposite to the two end walls 34, and a ring portion 37 that is connected to a bottom portion of the main wall 33. The end walls 34 define an accommodating slot 30 therebetween, and top portions of the end walls 34 are connected to each other. Each of the end walls 34 has an elongated groove 341 that is elongated in the vertical direction (Z), and that is defined by a groove-defining surface. The mounting rod 24 extends through the elongated grooves 341 of the end walls 34. One of the end walls 34 of the second body member 31 further has a fixing seat 342 that is disposed below the hook wall 35, and that is spaced apart from the accommodating slot 30 in the horizontal direction (X). The fixing seat 342 has a fixing notch 343 that is in spatial communication with the mounting space 200. The hook wall 35 is disposed above the top surface 271 of the platform 27, extends towards the first latch portion 22, and has an extending hole 351 that is aligned with the fixing notch 343. The ring portion 37 extends downwardly, and cooperates with the hook wall 35 to define a cavity chamber 38 accommodating the platform 27.

The spring member 32 is disposed in the accommodating slot 30, and has opposite ends that respectively abut against the mounting rod 24 and the second body member 31. In this embodiment, the spring member 32 is a compression spring.

Referring to FIGS. 4 and 8, the second latch portion 36 has two obstructing walls 361 that are spaced apart from each other in the horizontal direction (X), and each of the obstructing walls 361 has a trapezoid shape.

Referring to FIGS. 7 and 9, the pulling rope unit 4 extends through the threading hole 262, and has an end fixed to the second latch unit 3, and an opposite end disposed outside of the threading hole 262. In this embodiment, the pulling rope unit 4 has a fixing head 41 disposed at the end of the pulling rope unit 4 and secured on the fixing seat 342, a rope 42 extending from the fixing head 41 via the rope groove 272 and the threading hole 262 to the opposite end of the pulling rope unit 4, and a force-exertion portion 43 mounted to an end of the rope 42 opposite to the fixing head 41. The extending hole 351 is larger than the fixing head 41 so that the fixing head 41 may pass through the extending hole 351, and the fixing head 41 is larger than the fixing notch 343 so that the fixing head 41 may be secured to the fixing seat 342. Specifically, the rope 42 extends through the fixing notch 343, downwardly through the straight groove portion 273, curving through the curved groove portion 274, and through the threading hole 262, and is connected to the force-exertion portion 43. In this embodiment, the rope 42 is a steel rope, and the force-exertion portion 43 is a gourd-shaped knob.

Referring to FIG. 5, when the first corner casting 91 and the second corner casting 92 are separated by the connecting wall 28, a gap between the first corner casting 91 and the second corner casting 92 is formed, and exposes the rope 42 and force-exertion portion 43. Hence, the structure of the embodiment is unaffected by the top and bottom shipping containers that are stacked together.

Figure 10:
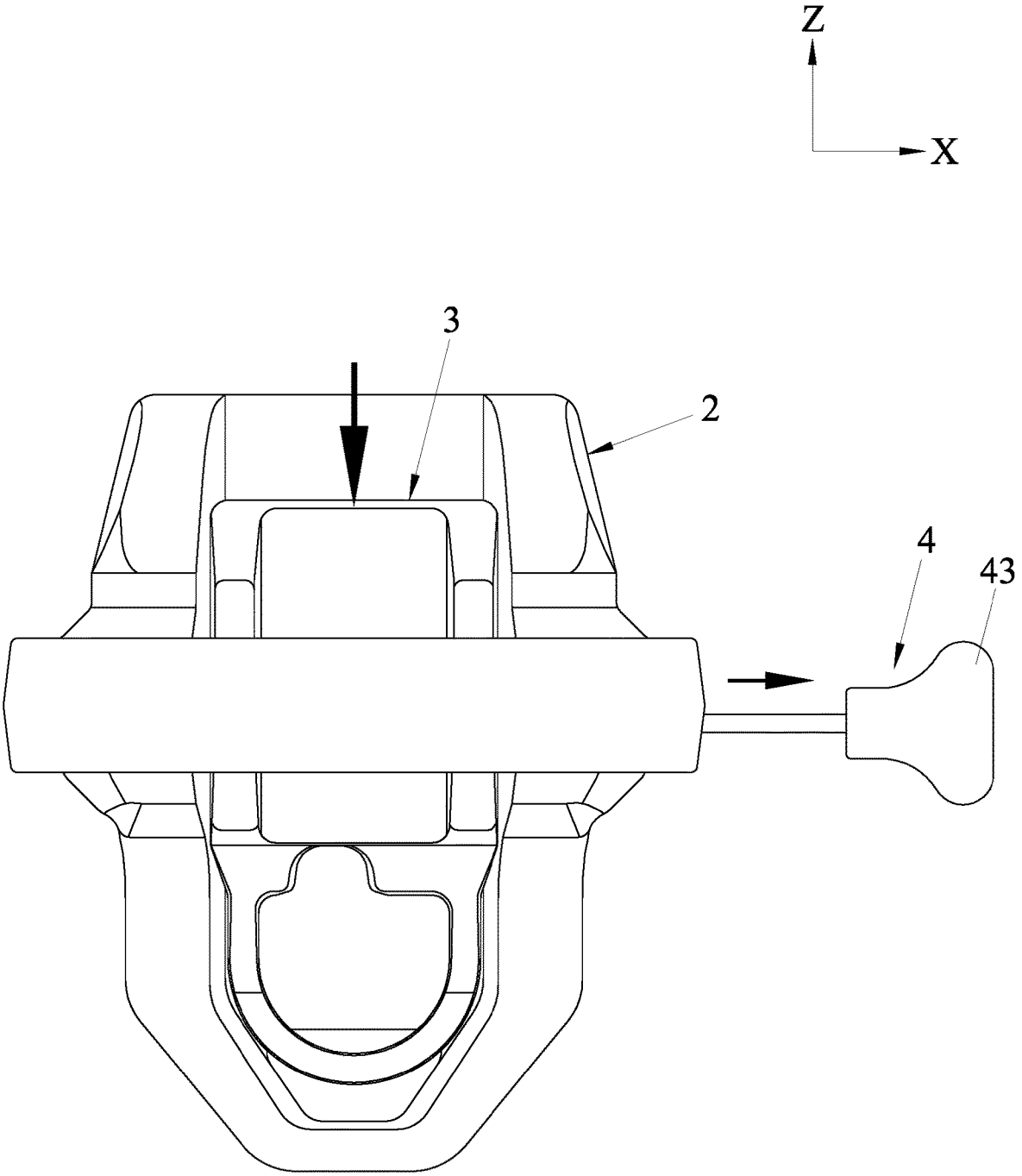
FIG. 10 is a view similar to FIG. 8, but illustrating the second latch unit in a released position.

Referring to FIGS. 8 and 10, when the pulling rope unit 4 is pulled, a force that is transverse to the vertical direction (Z) is generated to drive the second latch unit 3 to move relative to the first latch unit 2 from a locked position to a released position.

Figure 11:
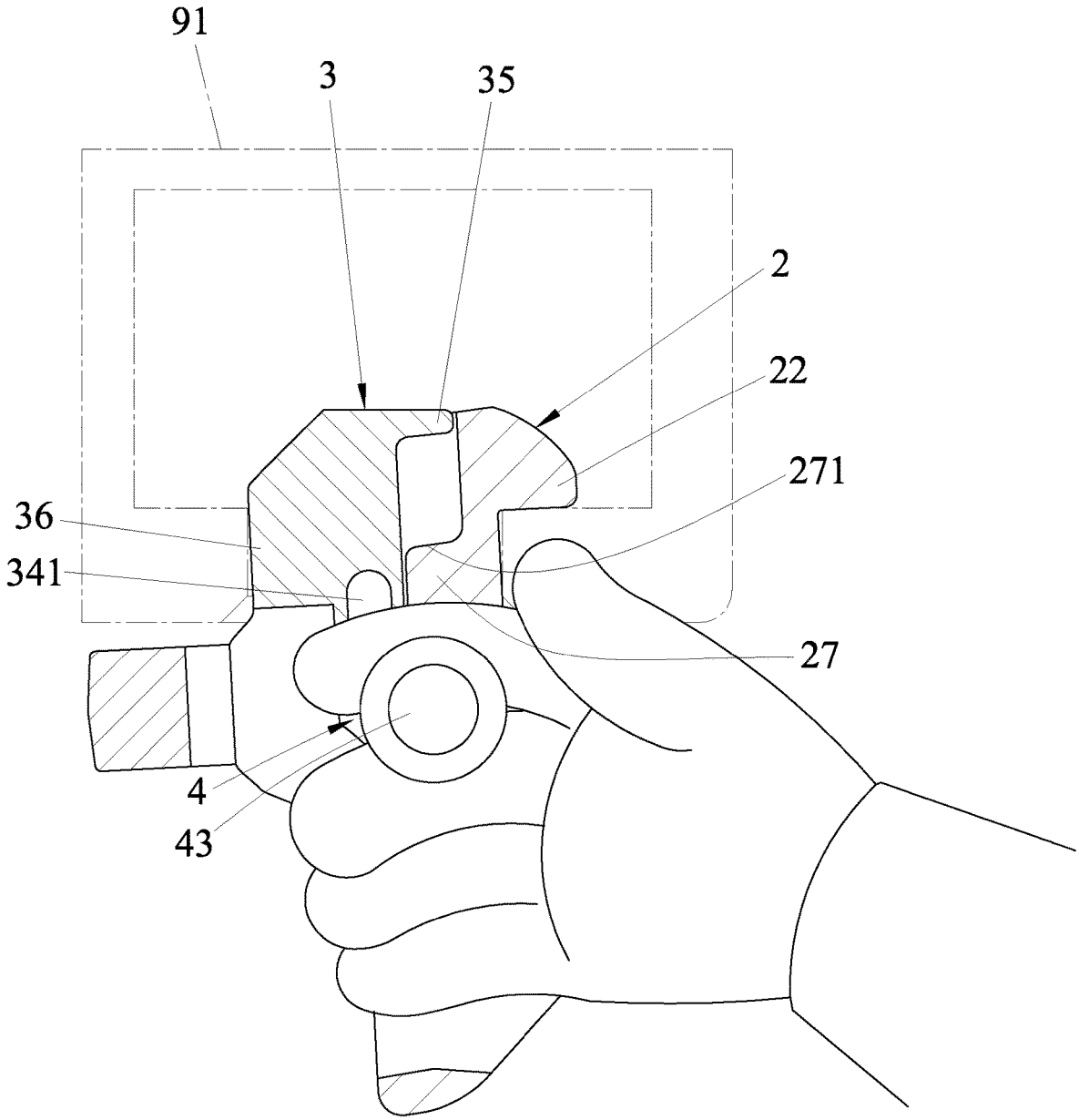
FIG. 11 is a schematic sectional view illustrating the second latch unit in the locked position.

Referring to FIGS. 7, 8 and 11, when the second latch unit 3 is in the locked position, the hook wall 35 and the second latch portion 36 are adjacent to the first latch portion 22, the mounting rod 24 abuts against bottom ends of the groove-defining surfaces of the end walls 34, and the hook wall 35 is spaced apart from the top surface 271 of the platform 27, so that the second latch portion 36 and the first latch portion 22 are adapted for cooperatively engaging with the first corner casting 91.

Figure 12:
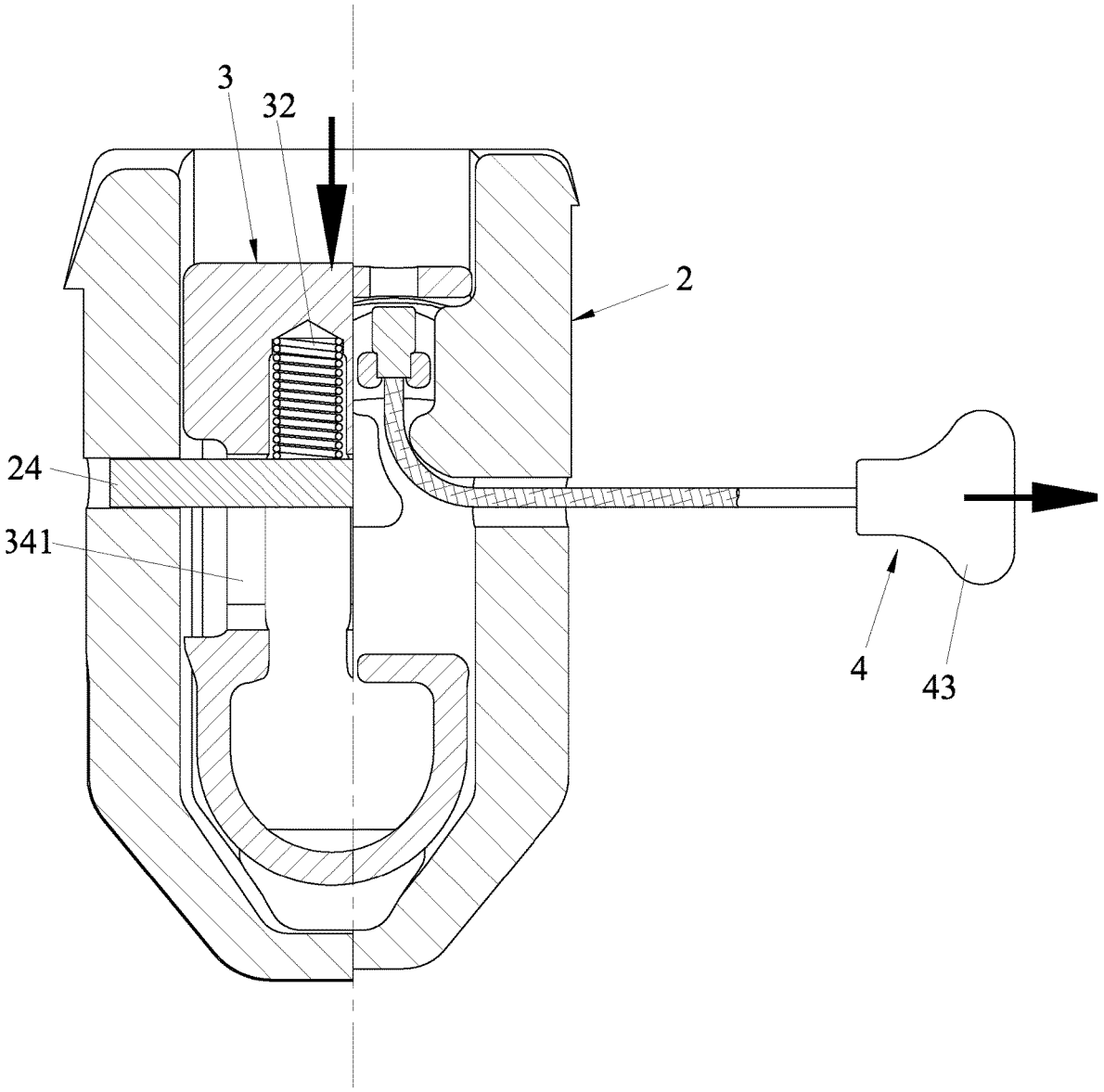
FIG. 12 is a view similar to FIG. 7, but illustrating the second latch unit in the released position.
Figure 13:
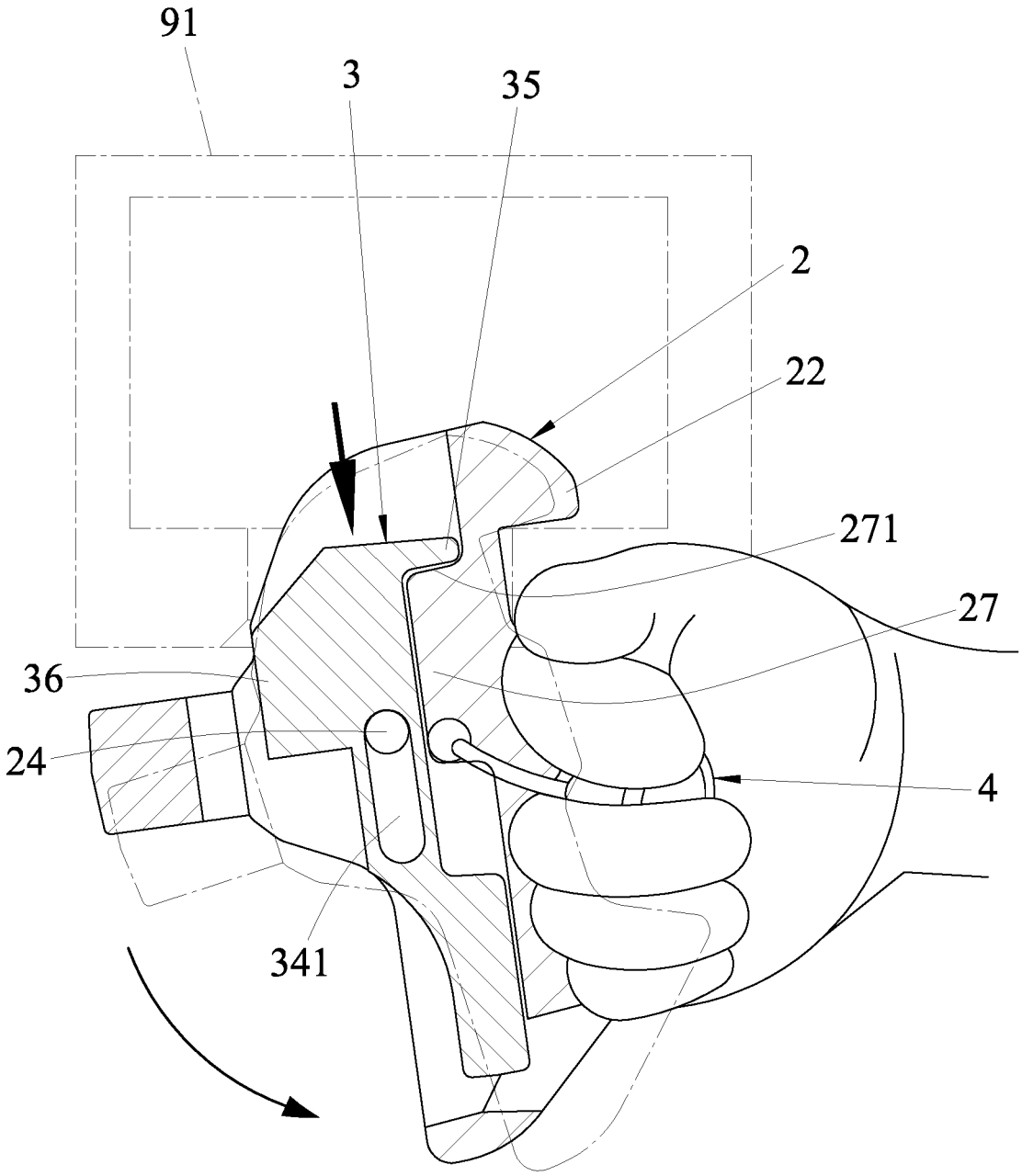
FIG. 13 is a view similar to FIG. 11, but illustrating that the second latch unit is in the released position, and that the embodiment is being disengaged from the first corner casting.

Referring to FIGS. 10, 12 and 13, when the second latch unit 3 is in the released position, the second latch portion 36 is away from the first latch portion 22, the hook wall 35 abuts against the top surface 271 of the platform 27, the spring member 32 accumulates a biasing force for biasing the second latch unit 3 towards the locked position, and the mounting rod 24 abuts against top ends of the groove-defining surfaces of the end walls 34, so that the second latch portion 36 and the first latch portion 22 are adapted to be disengaged from the first corner casting 91.

During movement of the second latch unit 3 from the locked position to the released position, the elongated grooves 341 of the end walls 34 move downwardly relative to the mounting rod 24. The presence of the elongated grooves 341 restrict movement of the second latch unit 3.

It should be noted that, before disengaging the embodiment from the first corner casting 91, the protruding portion 23 should be disengaged from the second corner casting 92.

Afterward, a user can pull the force-exertion portion 43 of the pulling rope unit 4 in a direction away from the first corner casting 91, and since the fixing head 41 of the pulling rope unit 4 is secured to the second latch unit 3, the second latch unit 3 is consequently driven to downwardly move from the locked position to the released position, thereby disengaging the embodiment from the first corner casting 91. Since the user holds the force-exertion portion 43 of the pulling rope unit 4, the user may keep a safe distance from the top shipping container while using the embodiment, thereby increasing safety.

In conclusion, since the opposite end of the pulling rope unit 4 is disposed outside of the threading hole 262 and is exposed, so that the user may keep a safe distance from the top shipping container. The user may use one hand to pull the force-exertion portion 43 in a direction away from the first corner casting 91 to disengage the shipping container connector from the first corner casting 91. Hence, the shipping container connector may be used with one hand, and allows the user to keep a safe distance from the shipping container to avoid being injured due to collision, thus increasing safety while using the shipping container connector and achieving the objective of the disclosure.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A shipping container connector adapted to be engaged with a first corner casting and a second corner casting, said shipping container connector comprising:

a first latch unit that has a first body member and a first latch portion arranged in a vertical direction, and a protruding portion disposed on a bottom end of said first body member, and adapted to be inserted into the second corner casting, said first latch portion being connected to a top end of said first body member, and adapted to be engaged with the first corner casting, said first body member having two side walls that are spaced apart in a horizontal direction perpendicular to the vertical direction, each of said side walls having a top end that is connected to said first latch portion, said two side walls cooperatively defining a mounting space therebetween, one of said side walls having a threading hole that is adapted to interconnect said mounting space to external environment;

a second latch unit that is disposed in said mounting space, that is vertically movable, and that includes:

a second body member disposed between said side walls, and having a second latch portion, and a spring member disposed between said second body member and said first latch unit; and a pulling rope unit that extends through said threading hole, and that has an end fixed to said second latch unit, and an opposite end disposed outside of said threading hole;

wherein, when said opposite end of said pulling rope unit is pulled, a force that is transverse to the vertical direction is generated to drive said second latch unit to move relative to said first latch unit from a locked position to a released position; and wherein, when said second latch unit is in the locked position, said second latch portion is adjacent to said first latch portion, so that said second latch portion and said first latch portion are adapted for cooperatively engaging with the first corner casting; and wherein, when said second latch unit is in the released position, said second latch portion is away from said first latch portion, so that said second latch portion and said first latch portion are adapted to be disengaged from the first corner casting, and said spring member accumulates a biasing force for biasing said second latch unit towards the locked position.

2. The shipping container connector as claimed in claim 1, wherein:

said second body member further has a main wall, and two end walls connected to said main wall, being opposite to said second latch portion, being spaced apart from each other, and defining an accommodating slot therebetween; and said spring member is disposed in said accommodating slot.

3. The shipping container connector as claimed in claim 2, wherein:

each of said side walls has an installation hole;

each of said end walls has an elongated groove that is elongated in the vertical direction;

said first latch unit further has a mounting rod that extends through said elongated grooves of said end walls and that has opposite ends respectively disposed in said installation holes of said side walls;

said spring member has opposite ends that respectively abut against said mounting rod and said second body member; and during movement of said second latch unit from the locked position to the released position, said elongated grooves of said end walls move downwardly relative to said mounting rod.

4. The shipping container connecter as claimed in claim 1, wherein:

said second body member further has an accommodating slot accommodating said spring member, and a fixing seat spaced apart from said accommodating slot in the horizontal direction; and said pulling rope unit has a fixing head disposed at said end of said pulling rope unit and secured on said fixing seat, and a rope extending from said fixing head via said threading hole to said opposite end of said pulling rope unit.

5. The shipping container connector as claimed in claim 1, wherein:

said first body member further has a rope groove disposed between said side walls, and having a straight groove portion that is elongated in the vertical direction, and a curved groove portion that extends from said straight groove portion to said threading hole, and that is curved; and said pulling rope unit extends through said rope groove.

6. The shipping container connector as claimed in claim 1, wherein:

said first body member further has:

a base wall, said side walls being disposed on said base wall, and a platform that is formed on said base wall, that is disposed in said mounting space, and that has a top surface;

said second body member further has a hook wall; and when said second latch unit is in the locked position, said hook wall is adjacent to said first latch portion and is disposed above and spaced apart from said top surface of said platform; and when said second latch unit is in the released position, said hook wall abuts against said top surface of said platform.

7. The shipping container connecter as claimed in claim 6, wherein:

said second body member further has a fixing seat disposed below said hook wall;

said pulling rope unit has a fixing head disposed at said end of said pulling rope unit and secured on said fixing seat, and a rope extending from said fixing head via said threading hole to said opposite end of said pulling rope unit; and said hook wall has an extending hole larger than said fixing head.

8. The shipping container connector as claimed in claim 7, wherein said rope is a steel rope.

9. The shipping container connector as claimed in claim 7, wherein said fixing seat has a fixing notch, said rope extending through said fixing notch, said fixing head being larger than said fixing notch.

10. The shipping container connector as claimed in claim 1, wherein said first body member further has a connecting wall that extends in the horizontal direction and that interconnects said side walls, said connecting wall having two ends that are opposite to each other in the horizontal direction and that respectively extend beyond said side walls, said connecting wall being horizontally aligned with said threading hole.

* * * * *